US009230472B2

(12) United States Patent
Bae

(10) Patent No.: US 9,230,472 B2
(45) Date of Patent: Jan. 5, 2016

(54) ORGANIC LIGHT EMITTING DISPLAY AND DEGRADATION COMPENSATION METHOD THEREOF

(71) Applicant: LG DISPLAY CO., LTD., Seoul (KR)

(72) Inventor: Hanjin Bae, Seoul (KR)

(73) Assignee: LG DISPLAY CO., LTD., Seoul (KR)

( * ) Notice: Subject to any disclaimer, the term of this patent is extended or adjusted under 35 U.S.C. 154(b) by 404 days.

(21) Appl. No.: 13/679,595

(22) Filed: Nov. 16, 2012

(65) Prior Publication Data

US 2013/0147693 A1 Jun. 13, 2013

(30) Foreign Application Priority Data

Dec. 8, 2011 (KR) ..... 10-2011-0131217

(51) Int. Cl.
*G09G 3/32* (2006.01)

(52) U.S. Cl.
CPC ..... *G09G 3/3208* (2013.01); *G09G 3/3225* (2013.01); *G09G 2320/0223* (2013.01); *G09G 2320/0233* (2013.01); *G09G 2320/043* (2013.01); *G09G 2330/021* (2013.01)

(58) Field of Classification Search
CPC ..... G09G 3/30–3/3291; G09G 2320/043; G09G 2320/045
USPC ..... 345/76–78
See application file for complete search history.

(56) References Cited

U.S. PATENT DOCUMENTS

2006/0007249 A1* 1/2006 Reddy et al. ..... 345/690
2011/0122119 A1 5/2011 Bae et al.
2014/0375701 A1* 12/2014 Chaji et al. ..... 345/690

FOREIGN PATENT DOCUMENTS

KR 10-2011-0057531 A 6/2011
KR 10-2011-0057534 A 6/2011
KR 10-2011-0066506 A 6/2011

* cited by examiner

*Primary Examiner* — Roy Rabindranath
(74) *Attorney, Agent, or Firm* — Birch, Stewart, Kolasch & Birch, LLP

(57) ABSTRACT

An organic light emitting display includes a display panel including pixels, a degradation sensing circuit which senses a threshold voltage of organic light emitting diodes included in the pixels and calculates an average degradation value defined by an average luminance value due to the degradation based on the sensed threshold voltage, a compensation target adjustor which adjusts a compensation target based on the average degradation value, each time the average degradation value is reduced by a previously determined reference value, and a data modulator which adds and subtracts a luminance compensation value determined depending on the adjusted compensation target to and from digital video data and modulates the digital video data.

9 Claims, 12 Drawing Sheets

ORGANIC LIGHT EMITTING DISPLAY AND DEGRADATION COMPENSATION METHOD THEREOF

This application claims the benefit of Korean Patent Application No. 10-2011-0131217 filed on Dec. 8, 2011, which is incorporated herein by reference for all purposes as if fully set forth herein.

BACKGROUND OF THE INVENTION

1. Field of the Invention

Embodiments of the invention relate to an organic light emitting display, and more particularly to an organic light emitting display and a degradation compensation method thereof capable of compensating for degradation of an organic light emitting diode.

2. Discussion of the Related Art

An organic light emitting display, which has been considered as the next generation display, includes a self-emitting element capable of emitting light by itself, and thus has advantages including a fast response time, a high light emitting efficiency, a high luminance, a wide viewing angle, etc.

The organic light emitting display includes an organic light emitting diode (hereinafter, abbreviated to "OLED") serving as the self-emitting element. The OLED includes an anode electrode, a cathode electrode, and an organic compound layer formed between the anode electrode and the cathode electrode. The organic compound layer includes a hole injection layer, a hole transport layer, a light emitting layer, an electron transport layer, and an electron injection layer. When a driving voltage is applied to the anode electrode and the cathode electrode, holes passing through the hole transport layer and electrons passing through the electron transport layer move to the light emitting layer to form excitons. As a result, the light emitting layer generates visible light.

In the organic light emitting display, pixels each including the OLED are arranged in a matrix form, and brightness of the pixels is controlled based on a gray level of video data. The organic light emitting display is mainly classified into a passive matrix organic light emitting display and an active matrix organic light emitting display using thin film transistors (TFTs) as a switching element. The active matrix organic light emitting display selectively turns on the TFT serving as the active element to select the pixel and holds the light emission of the pixel using a hold voltage of a storage capacitor.

There are several factors which reduce the luminance uniformity between the pixels in the organic light emitting display. A deviation between electrical characteristics of driving TFTs of the pixels, a deviation between cell driving voltages of the pixels, a degradation deviation between the OLEDs of the pixels, etc. have been known as the factors. The degradation deviation between the OLEDs of the pixels is generated because the pixels each have a different degradation speed based on the same usage time. The degradation deviation between the OLEDs leads to an image sticking phenomenon, thereby reducing image quality of the organic light emitting display.

To compensate for a luminance reduction resulting from the degradation of the OLED, a technology which applies a uniform programming current to the OLED to thereby sense a threshold voltage of the OLED and differently adjusts video data for the light emission of the OLED based on the sensed threshold voltage, has been known. As the degradation of the OLED deepens, the sensed threshold voltage increases and an output luminance is reduced. Therefore, a related art technology sets a compensation target for the luminance compensation and modulates the video data based on the sensed threshold voltage, thereby adjusting the output luminance in conformity with the compensation target.

However, as shown in FIG. 1, in the related art technology, the compensation target is set to an ideal luminance of an OLED, which is hardly used (i.e., has not yet been degraded), and the degraded pixels are compensated for their luminances based on the compensation target. Therefore, as usage time of the OLED passed, a luminance gap between the compensation target and a luminance to be compensated gradually increases. Hence, in the related art technology, as usage time of the OLED passed, power consumption required to compensate for the degradation of the OLED gradually increases. In FIG. 1, 'Best Pixel' indicates a pixel showing the ideal luminance, and 'Worst Pixel' indicates a pixel which is degraded and is subject to compensation as usage time of the OLED passed.

Furthermore, in the related art technology, because the compensation target is set to the ideal luminance, the luminance gap between the compensation target and the luminance subject to compensation gradually increases as usage time of the OLED passed. Hence, a compensation error increases. One factor generating the compensation error is an IR drop resulting from a resistance difference of a cell driving voltage supply line based on its location. As the compensation error increases, a luminance balance and a color balance of a display image of the organic light emitting display may not be kept.

SUMMARY OF THE INVENTION

Embodiments of the invention provide an organic light emitting display and a degradation compensation method thereof capable of reducing power consumption required to compensate for degradation of an organic light emitting diode and minimizing a compensation error.

In one aspect, there is an organic light emitting display including a display panel configured to display an image, the display panel including a plurality of pixels, a degradation sensing circuit configured to sense a threshold voltage of organic light emitting diodes included in the pixels and calculate an average degradation value defined by an average luminance value due to the degradation based on the sensed threshold voltage of the organic light emitting diodes, a compensation target adjustor configured to adjust a compensation target, which is a criterion of the luminance compensation, based on the average degradation value, each time the average degradation value is reduced by a previously determined reference value, and a data modulator configured to add and subtract a luminance compensation value determined depending on the adjusted compensation target to and from input digital video data and modulate the input digital video data.

Each time the average degradation value is reduced by the previously determined reference value, the compensation target adjustor reduces stepwise the compensation target in conformity with changes in the average degradation value.

A stepwise adjustment width of the compensation target may be uniform or non-uniform.

The stepwise adjustment width of the compensation target may gradually increase in conformity with changes in the average degradation value.

The compensation target adjustor includes a plurality of lookup tables, in which different compensation target values and luminance compensation values based on the different compensation target values are previously stored. The compensation target adjustor selects one of the plurality of lookup tables in conformity with changes in the average degradation value to change stepwise the compensation target.

The compensation target adjustor includes a plurality of numerical algorisms, which are previously set so as to determine different compensation target values based on the average degradation value and luminance compensation values based on the different compensation target values. The compensation target adjustor selects one of the plurality of numerical algorisms in conformity with changes in the average degradation value to change stepwise the compensation target.

The plurality of numerical algorisms may be determined by a functional equation to adopt one of average degradation coefficients, which are previously set depending on the average degradation value, as an offset value.

The compensation target adjustor includes a lookup table, in which a reference luminance compensation value is previously stored, and an offset adjustor which adjusts an offset value of the reference luminance compensation value output from the lookup table to change the compensation target.

The offset adjustor adds one of average degradation coefficients, which are previously set depending on the average degradation value, to the reference luminance compensation value to adjust the offset value of the reference luminance compensation value.

The offset adjustor additionally adds one of degradation weighting coefficients, which are previously set depending on the average degradation value, to the reference luminance compensation value to adjust the offset value of the reference luminance compensation value.

In another aspect, there is a degradation compensation method of an organic light emitting display including a display panel, which includes a plurality of pixels and displays an image, the degradation compensation method including sensing a threshold voltage of organic light emitting diodes included in the pixels and calculating an average degradation value defined by an average luminance value due to the degradation based on the sensed threshold voltage of the organic light emitting diodes, adjusting a compensation target, which is a criterion of the luminance compensation, based on the average degradation value, each time the average degradation value is reduced by a previously determined reference value, and adding and subtracting a luminance compensation value determined depending on the adjusted compensation target to and from input digital video data and modulating the input digital video data.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE EMBODIMENTS

Reference will now be made in detail to embodiments of the invention, examples of which are illustrated in the accompanying drawings. Wherever possible, the same reference numbers will be used throughout the drawings to refer to the same or like parts. It will be paid attention that detailed description of known arts will be omitted if it is determined that the arts can mislead the embodiments of the invention.

Example embodiments of the invention will be described with reference to FIGS. 2 to 13.

Figure 1:
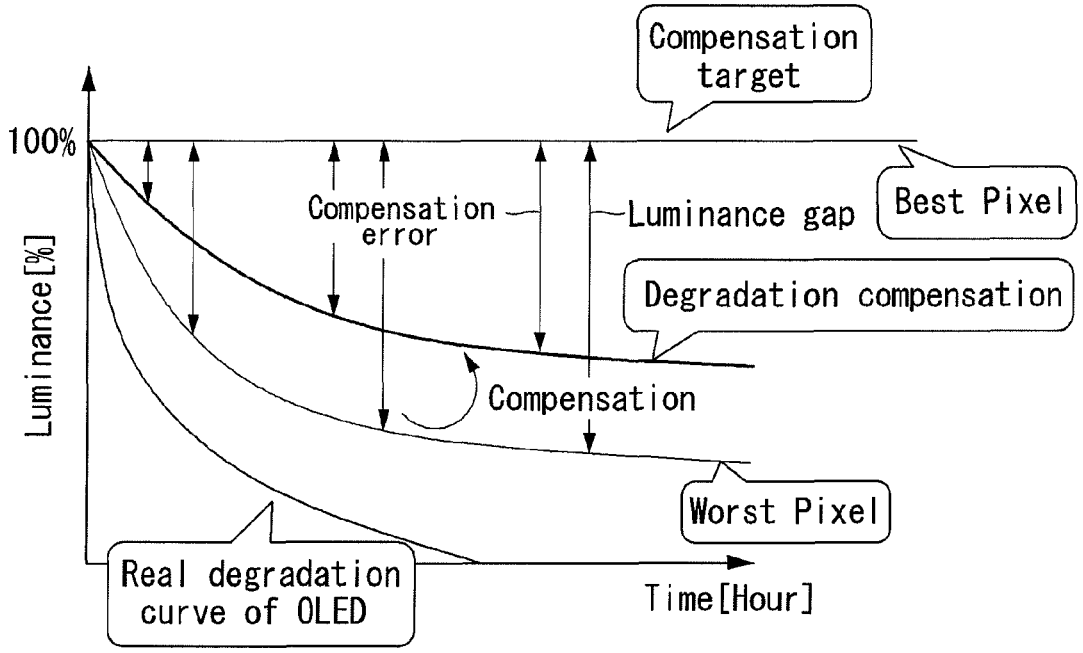
FIG. 1 (RELATED ART)
FIG. 1 is a graph showing a related art degradation compensation method of an organic light emitting display.
Figure 2:
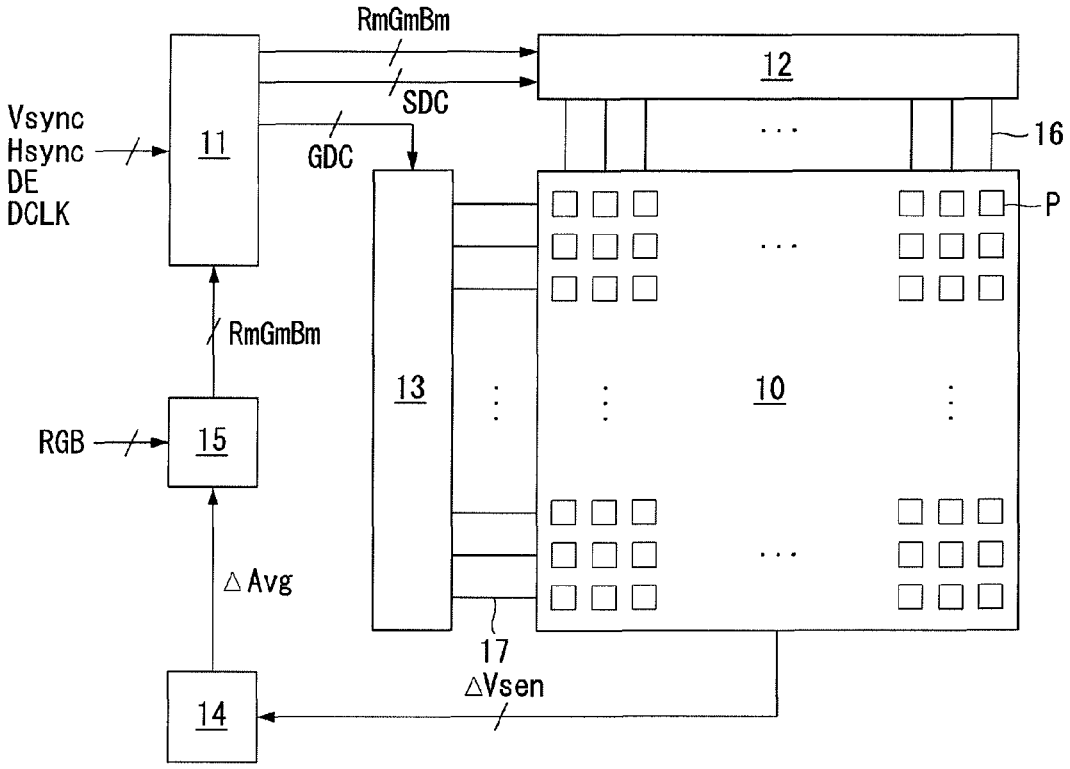
FIG. 2 illustrates an organic light emitting display according to an example embodiment of the invention.

FIG. 2 illustrates an organic light emitting display according to an example embodiment of the invention.

As shown in FIG. 2, an organic light emitting display according to an example embodiment of the invention includes a display panel 10 including pixels P which are arranged in a matrix form, a data driving circuit 12 for driving data lines 16, a gate driving circuit 13 for driving gate line groups 17, a timing controller 11 for controlling operations of the driving circuits 12 and 13, a degradation sensing circuit 14 for sensing degradation of an organic light emitting diode (hereinafter, abbreviated to "OLED") included in each of the pixels P, and a degradation compensation circuit 15 which modulates input digital video data and compensates for a luminance reduction resulting from the degradation of the OLEDs.

The display panel 10 includes the plurality of data lines 16, the plurality of gate line groups 17 crossing the data lines 16, and the plurality of pixels P respectively positioned at crossings of the data lines 16 and the gate line groups 17. Each of the plurality of gate line groups 17 may include a scan pulse supply line for the supply of a scan pulse, an emission pulse supply line for the supply of an emission pulse, and a sensing pulse supply line for the supply of a sensing pulse. Each gate line group 17 may further include an initialization line for supplying an initialization voltage based on a structure of a pixel circuit. Each pixel P is connected to the data driving circuit 12 through the data lines 16 and is connected to the gate driving circuit 13 through the gate line groups 17.

Each pixel P may include an OLED, a driving thin film transistor (TFT) for controlling an amount of driving current flowing in the OLED based on a data voltage, at least one switching TFT, a storage capacitor, etc. The pixel P may have any known structure as long as it can sense a threshold voltage $\Delta Vsen$ of the OLED. For example, the pixel P may be designed to have the same structure as a pixel disclosed in detail in Korean Patent Application Nos. 10-2009-0113974 (Nov. 24, 2009), 10-2009-0113979 (Nov. 24, 2009), and 10-2009-0123190 (Dec. 11, 2009) corresponding to the present applicant, and which are hereby incorporated by reference in their entirety.

The timing controller 11 receives timing signals such as a vertical sync signal Vsync, a horizontal sync signal Hsync, a dot clock DCLK, and a data enable DE from a system board (not shown) and generates a source control signal SDC for controlling operation timing of the data driving circuit 12 and a gate control signal GDC for controlling operation timing of the gate driving circuit 13 based on the timing signals Vsync, Hsync, DCLK, and DE.

The timing controller 11 receives digital modulation data RmGmBm for the degradation compensation from the degradation compensation circuit 15 and arranges the digital modulation data RmGmBm in conformity with the display panel 10. The timing controller 11 supplies the arranged digital modulation data RmGmBm to the data driving circuit 12. The timing controller 11 produces programming data to be applied to the pixels P in a degradation sensing period of the OLEDs of the pixels P and supplies the programming data to the data driving circuit 12. The programming data to be applied to the pixels P may be selected as a value suitable to sense the threshold voltage ΔVsen of the OLEDs.

The timing controller 11 may separately set an image display period, in which a display image is implemented in a state where the OLED is compensated for its degradation deviation through the data modulation, and a degradation sensing period, in which the threshold voltage ΔVsen of the OLEDs is sensed. The degradation sensing period may be set to at least one frame period synchronized with on-timing of a driving power source or at least one frame period synchronized with off-timing of the driving power source. The degradation sensing period may be set to a vertical blank period between every two image display periods. The timing controller 11 may differently control operations of the data driving circuit 12 and the gate driving circuit 13 in the image display period and the degradation sensing period.

During the image display period, the data driving circuit 12 converts the digital modulation data RmGmBm into the data voltage under the control of the timing controller 11 and supplies the data voltage to the data lines 16. During the degradation sensing period, the data driving circuit 12 converts the programming data received from the timing controller 11 into a programming voltage under the control of the timing controller 11 and supplies the programming voltage to the data lines 16.

The gate driving circuit 13 includes a shift register and a level shifter and generates the scan pulse, the sensing pulse, and the emission pulse under the control of the timing controller 11. The scan pulse is applied to the scan pulse supply line, the emission pulse is applied to the emission pulse supply line, and the sensing pulse is applied to the sensing pulse supply line. The shift register constituting the gate driving circuit 13 may be directly formed on the display panel 10 in a Gate In Panel (GIP) manner.

The degradation sensing circuit 14 senses the threshold voltage ΔVsen of the OLEDs of the pixels P. The degradation sensing circuit 14 operates in the degradation sensing period under the control of the timing controller 11. The degradation sensing circuit 14 may use a sensing method disclosed in detail in Korean Patent Application Nos. 10-2009-0113974 (Nov. 24, 2009), 10-2009-0113979 (Nov. 24, 2009), and 10-2009-0123190 (Dec. 11, 2009) corresponding to the present applicant, and which are hereby incorporated by reference in their entirety. The degradation sensing circuit 14 calculates an average luminance value (hereinafter referred to as "average degradation value") ΔAvg due to the degradation based on the threshold voltage ΔVsen of the OLEDs obtained by a sensing operation. The average degradation value ΔAvg is an luminance index indicating a degradation degree throughout the entire area of the display panel 10. As usage time passed (i.e., as the degradation of the OLED deepens), the average degradation value ΔAvg decreases.

The degradation compensation circuit 15 receives the average degradation value ΔAvg from the degradation sensing circuit 14. Each time the average degradation value ΔAvg is reduced by a previously determined reference value, the degradation compensation circuit 15 adjusts a compensation target, which is a criterion of the luminance compensation, based on the average degradation value ΔAvg. The degradation compensation circuit 15 modulates input digital video data RGB based on the adjusted compensation target to produce the digital modulation data RmGmBm. The degradation compensation circuit 15 may be embedded in the timing controller 11.

Figure 3:
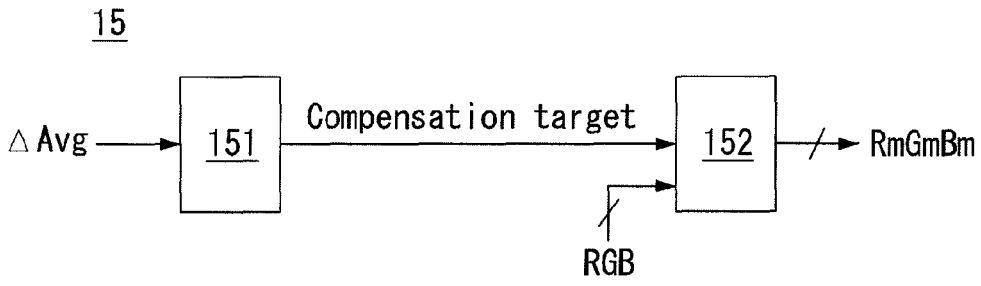
FIG. 3 illustrates a configuration of a degradation compensation circuit shown in FIG. 2.
Figure 4:
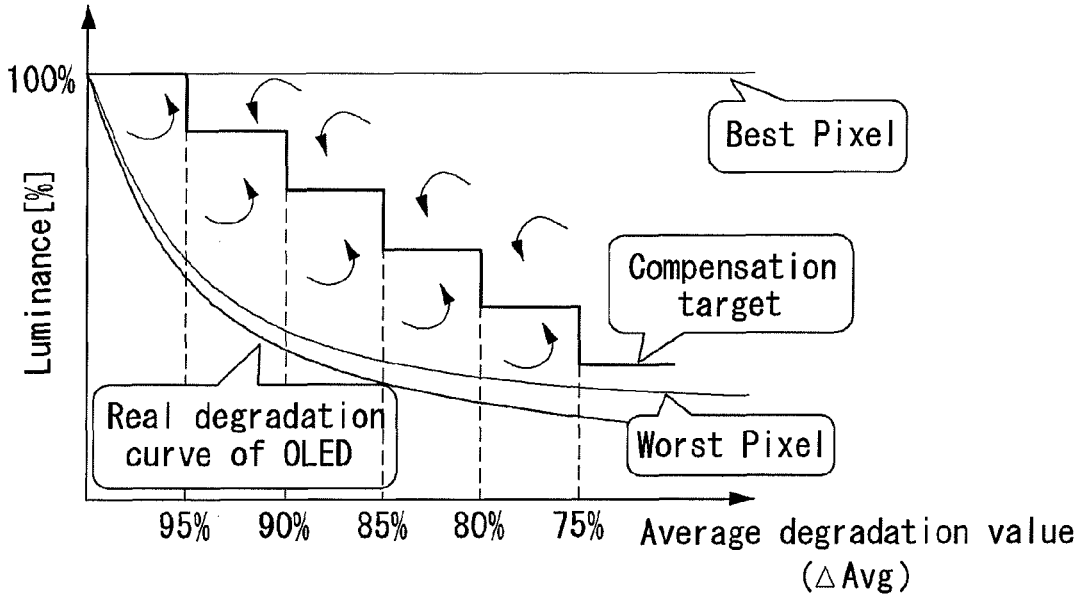
FIG. 4 is a graph showing stepwise adjustment of a compensation target depending on a degradation degree.

FIG. 3 illustrates a configuration of the degradation compensation circuit 15 shown in FIG. 2. FIG. 4 is a graph showing stepwise adjustment of a compensation target depending on a degradation degree.

As shows in FIG. 3, the degradation compensation circuit 15 includes a compensation target adjustor 151 which adjusts the compensation target based on the average degradation value ΔAvg, and a data modulator 152 which modulates the input digital video data RGB based on the adjusted compensation target.

Figure 6:
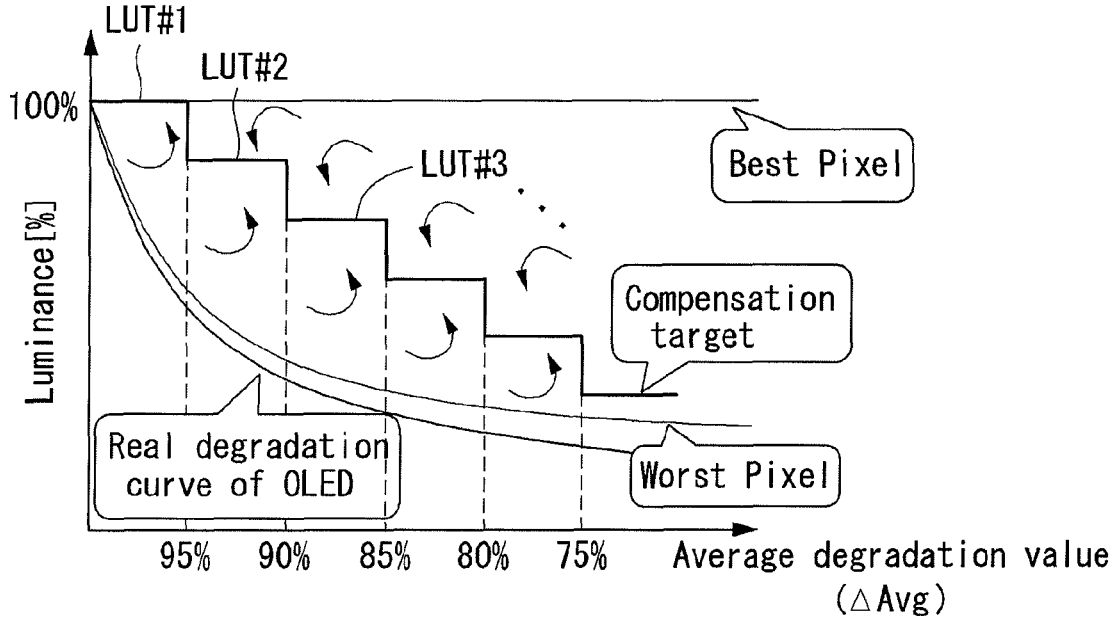
Figure 8:
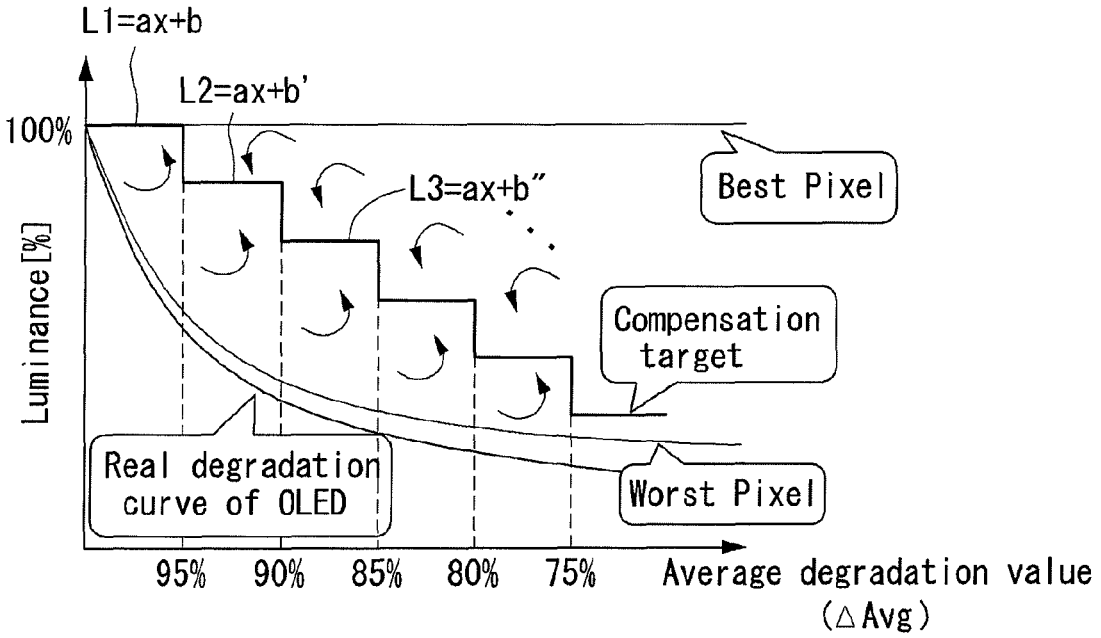
Figure 10:
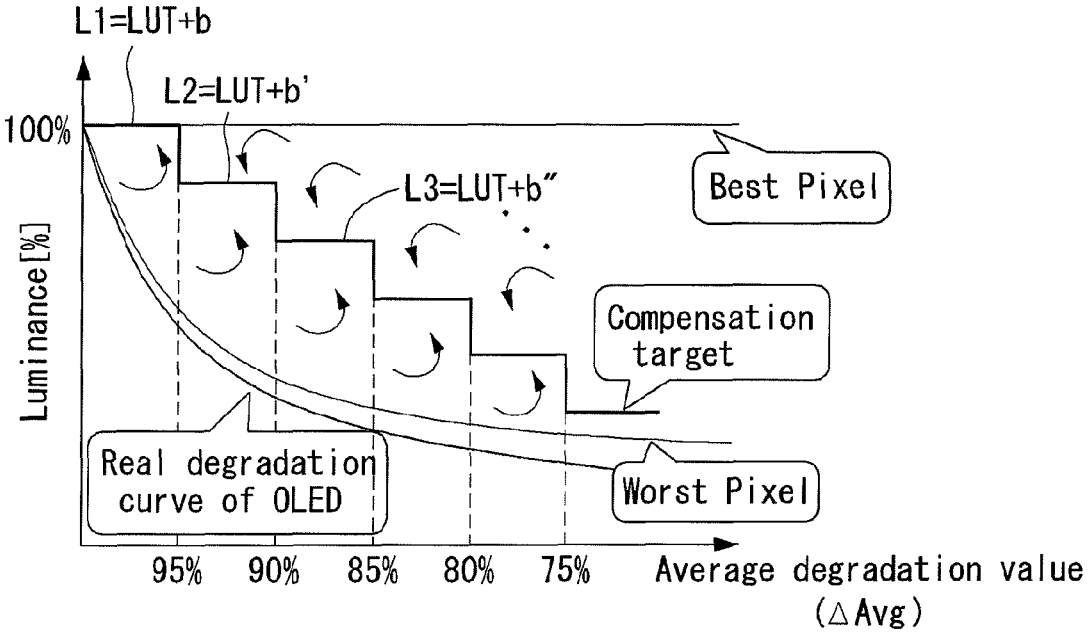
Figure 12:
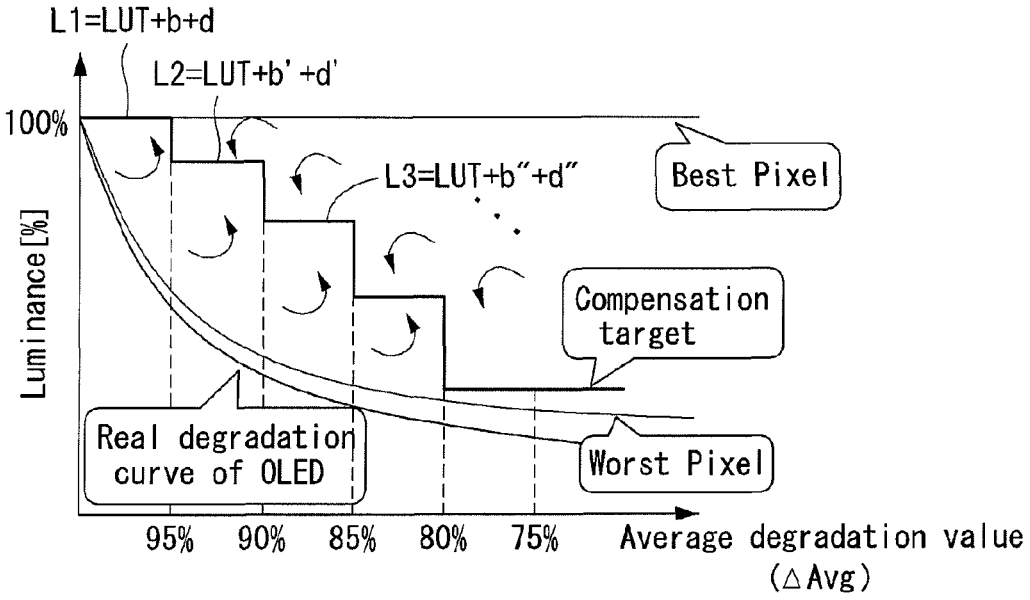

As shown in FIG. 4, each time the average degradation value ΔAvg is reduced by the previously determined reference value, the compensation target adjustor 151 reduces stepwise the compensation target in conformity with changes in the average degradation value ΔAvg, thereby reducing a luminance gap between the compensation target and a luminance subject to compensation. Because the average degradation value ΔAvg is defined by the average luminance value due to the degradation, the average degradation value ΔAvg is continuously reduced as usage time passed. FIG. 4 illustrates that the reference value is 5%, for example. The reference value may be set to other values. Furthermore, a stepwise adjustment width of the compensation target may be uniform or not-uniform. FIGS. 6, 8, and 10 illustrate that the stepwise adjustment width of the compensation target is uniform. It is a matter of course that a downward adjustment width of the compensation target in FIGS. 6, 8, and 10 may be not-uniform. FIG. 12 illustrates that the stepwise adjustment width of the compensation target gradually increases as the degradation of the OLED deepens. It is a matter of course that a downward adjustment width of the compensation target in FIG. 12 may be differently set.

The compensation target adjustor 151 adjusts the compensation target depending on the degradation degree to reduce the luminance gap between the compensation target and the luminance subject to compensation. Hence, the compensation target adjustor 151 may minimize a compensation error and may improve a compensation performance without breaking a luminance balance and a color balance. The compensation target adjustor 151 may reduce power consumption required in the degradation compensation by adjusting the compensation target depending on the degradation degree and reducing an entire luminance of the screen of the display panel 10.

The data modulator 152 adds and subtracts a luminance compensation value determined depending on the adjusted compensation target to and from the input digital video data RGB to thereby produce the digital modulation data RmGmBm. A pixel having a luminance higher than the compensation target through the data modulation operation represents the luminance lower than an original luminance of the pixel, and a pixel having a luminance lower than the compensation target through the data modulation operation represents the luminance higher than an original luminance of the pixel. Hence, the luminance difference between the pixels is reduced.

Figure 5:
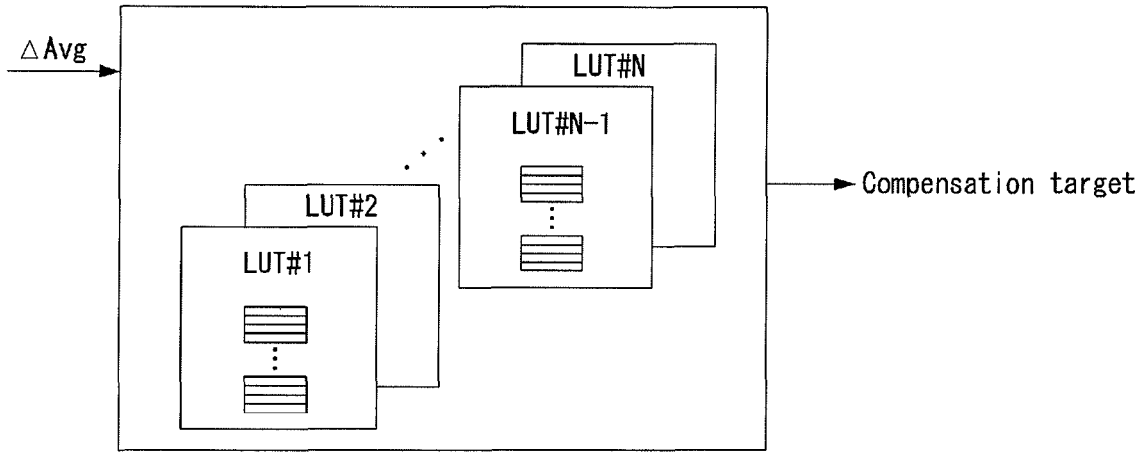
FIGS. 5 and 6 illustrate a first example of a compensation target adjustor.

FIGS. 5 and 6 illustrate a first example of the compensation target adjustor 151.

As shown in FIG. 5, the compensation target adjustor 151 according to the first example may include a plurality of lookup tables LUT#1 to LUT#N, which are previously set. Different compensation target values and luminance compensation values based on the different compensation target values are previously stored in the lookup tables LUT#1 to LUT#N. The compensation target adjustor 151 selects one of the lookup tables LUT#1 to LUT#N based on the average degradation value ΔAvg received from the degradation sensing circuit 14 and changes stepwise the compensation target based on the average degradation value ΔAvg.

For example, as shown in FIG. 6, the compensation target adjustor 151 selects the first lookup table LUT#1 when the average degradation value ΔAvg is 100%, selects the second lookup table LUT#2 when the average degradation value ΔAvg is 95%, and selects the third lookup table LUT#3 when the average degradation value ΔAvg is 90%. In other words, the compensation target adjustor 151 selects the different lookup table each time the average degradation value ΔAvg is reduced by the reference value (for example, 5%).

The compensation target and the luminance compensation value are determined depending on the selected lookup table. The data modulator 152 adds and subtracts the luminance compensation value determined by the selected lookup table to and from the input digital video data RGB.

Figure 7:
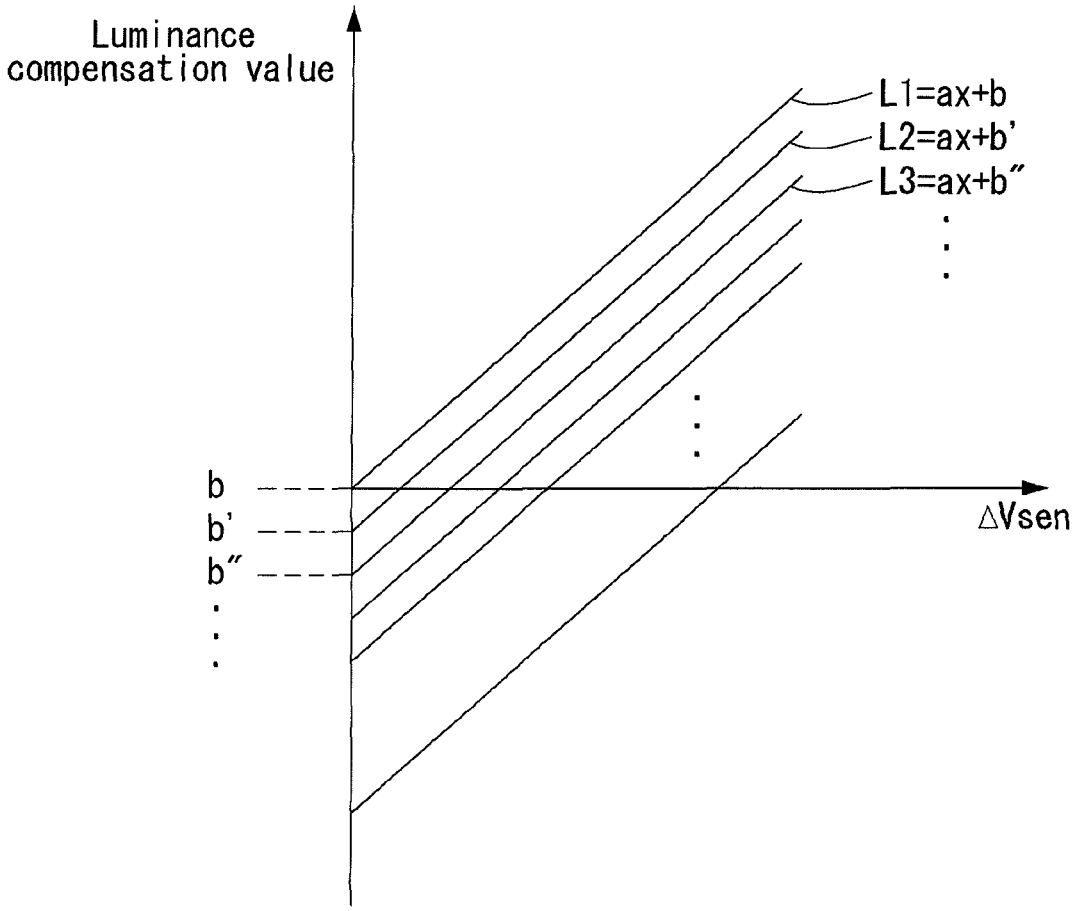
FIGS. 7 and 8 illustrate a second example of a compensation target adjustor.

FIGS. 7 and 8 illustrate a second example of the compensation target adjustor 151.

As shown in FIG. 7, the compensation target adjustor 151 according to the second example may include a plurality of numerical algorisms L1, L2, L3, . . . which are previously set. The numerical algorisms L1, L2, L3, . . . determine different compensation target values and luminance compensation values based on the different compensation target values depending on the average degradation value ΔAvg. For this, the numerical algorisms L1, L2, L3, . . . may be determined by a functional equation to adopt one of average degradation coefficients b, b', b", . . . , which are previously set depending on the average degradation value ΔAvg, as an offset value. The stepwise adjustment width of the compensation target depends on the offset value, and thus is determined depending on how the average degradation coefficients b, b', b", . . . are set. In FIG. 7, 'a' indicates a compensation coefficient, and 'x' indicates a degradation value based on the threshold voltage ΔVsen of the OLEDs. FIG. 7 illustrates that each of the numerical algorisms L1, L2, L3, . . . is defined by a linear function. However, the numerical algorisms L1, L2, L3, . . . are not limited thereto. The numerical algorisms L1, L2, L3, . . . may extend to an nth order function of 'x', where n is a positive integer equal to or greater than 2. The compensation target adjustor 151 selects one of the numerical algorisms L1, L2, L3, . . . based on the average degradation value ΔAvg received from the degradation sensing circuit 14 and changes stepwise the compensation target based on the average degradation value ΔAvg.

For example, as shown in FIG. 8, the compensation target adjustor 151 selects the first numerical algorism L1 when the average degradation value ΔAvg is 100%, selects the second numerical algorism L2 when the average degradation value ΔAvg is 95%, and selects the third numerical algorism L3 when the average degradation value ΔAvg is 90%. In other words, the compensation target adjustor 151 selects the different numerical algorism each time the average degradation value ΔAvg is reduced by the reference value (for example, 5%).

The compensation target and the luminance compensation value are determined depending on the selected numerical algorisms. The data modulator 152 adds and subtracts the luminance compensation value determined by the selected numerical algorisms to and from the input digital video data RGB.

Figure 9:
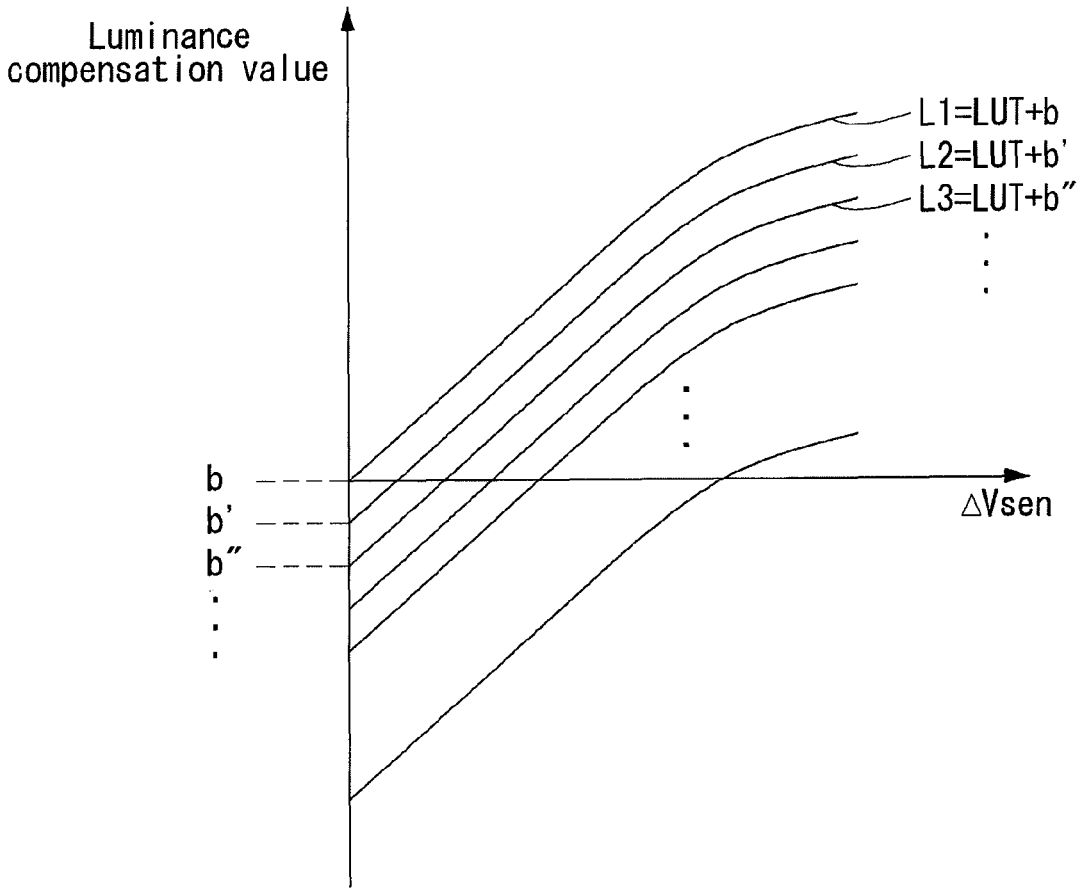
FIGS. 9 and 10 illustrate a third example of a compensation target adjustor.

FIGS. 9 and 10 illustrate a third example of the compensation target adjustor 151.

As shown in FIG. 9, the compensation target adjustor 151 according to the third example may include one lookup table, in which a reference luminance compensation value is previously stored, and an offset adjustor which adjusts an offset value of an output (i.e., the reference luminance compensation value) of the lookup table to change the compensation target. As shown in FIG. 10, the offset adjustor adds one of the average degradation coefficients b, b', b", . . . , which are previously set depending on the average degradation value ΔAvg, to the reference luminance compensation value output from the lookup table, thereby adjusting the offset value of the reference luminance compensation value. The stepwise adjustment width of the compensation target depends on the offset value, and thus is determined depending on how the average degradation coefficients b, b', b", . . . are set. The compensation target adjustor 151 adjusts the offset value of the reference luminance compensation value based on the average degradation value ΔAvg received from the degradation sensing circuit 14, thereby changing stepwise the compensation target based on the average degradation value ΔAvg.

For example, as shown in FIG. 10, when the average degradation value ΔAvg is 100%, the compensation target adjustor 151 adds the first average degradation coefficient b to the offset value of the output (i.e., the reference luminance compensation value) of the lookup table. When the average degradation value ΔAvg is 95%, the compensation target adjustor 151 adds the second average degradation coefficient b' to the offset value of the reference luminance compensation value of the lookup table. When the average degradation value ΔAvg is 90%, the compensation target adjustor 151 adds the third average degradation coefficient b" to the offset value of the reference luminance compensation value of the lookup table. In other words, the compensation target adjustor 151 changes the average degradation coefficient added to the output (i.e., the reference luminance compensation value) of the lookup table each time the average degradation value ΔAvg is reduced by the reference value (for example, 5%).

When the average degradation coefficient is added to the output (i.e., the reference luminance compensation value) of the lookup table, the compensation target and a final luminance compensation value are determined. The data modulator 152 adds and subtracts the determined final luminance compensation value to and from the input digital video data RGB.

Figure 11:
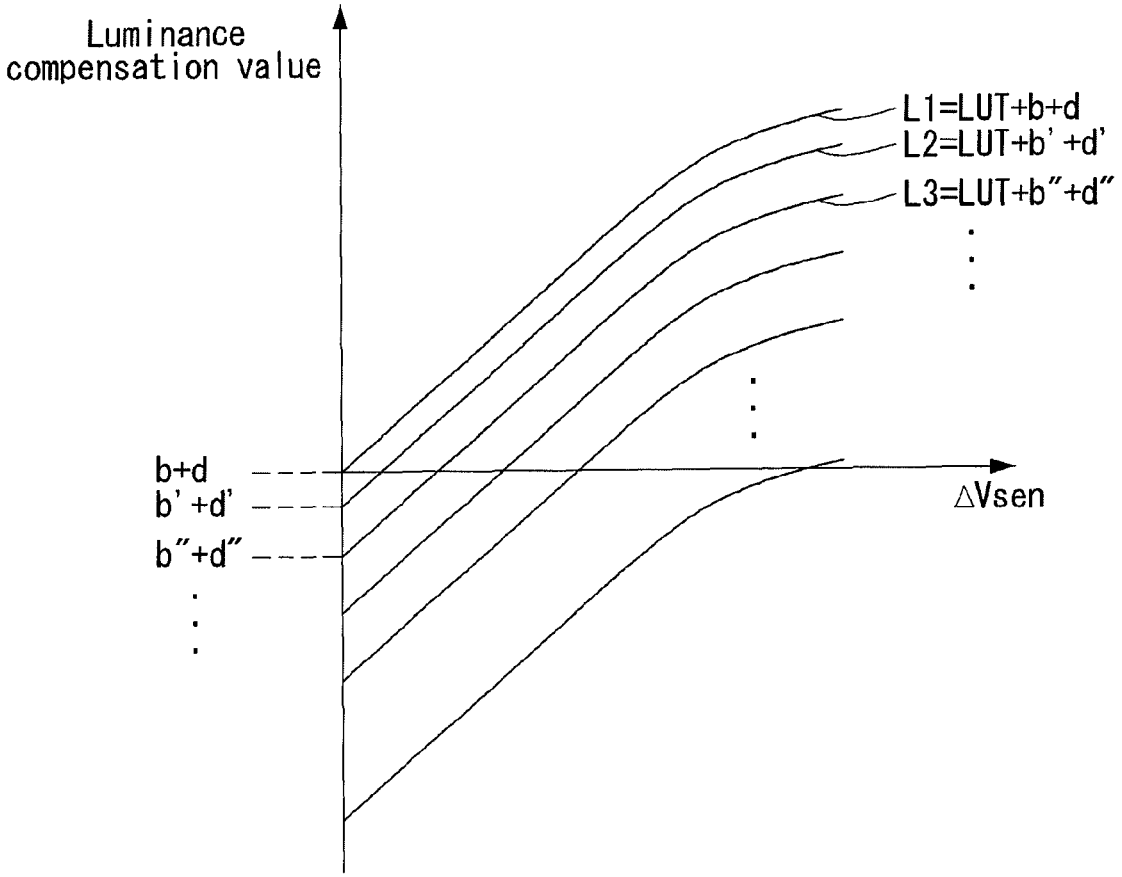
FIGS. 11 and 12 illustrate a fourth example of a compensation target adjustor.

FIGS. 11 and 12 illustrate a fourth example of the compensation target adjustor 151.

The compensation target adjustor 151 according to the fourth example is different from the compensation target adjustor 151 according to the third example in a function of the offset adjustor. An offset adjustor according to the fourth example adjusts the offset value of the reference luminance compensation value of the lookup table using the average degradation coefficients b, b', b", . . . and degradation weighting coefficients d, d', d", . . . , thereby gradually increasing the stepwise adjustment width of the compensation target as the degradation deepens.

More specifically, as shown in FIG. 11, the compensation target adjustor 151 according to the fourth example may include one lookup table, in which a reference luminance compensation value is previously stored, and an offset adjustor which adjusts an offset value of an output (i.e., the reference luminance compensation value) of the lookup table to change the compensation target. As shown in FIG. 12, the offset adjustor adds one of the average degradation coefficients b, b', b", . . . , which are previously set depending on the average degradation value ΔAvg, and one of the degradation weighting coefficients d, d', d", . . . to the reference luminance compensation value output from the lookup table, thereby adjusting the offset value of the reference luminance compensation value. As the degradation deepens, the stepwise adjustment width of the compensation target may gradually increase because the degradation weighting coefficients d, d', d", . . . are additionally added to the offset value of the reference luminance compensation value. The compensation target adjustor 151 adjusts the offset value of the reference luminance compensation value based on the average degradation value ΔAvg received from the degradation sensing circuit 14, thereby changing stepwise the compensation target based on the average degradation value ΔAvg.

For example, as shown in FIG. 12, when the average degradation value ΔAvg is 100%, the compensation target adjustor 151 adds the first average degradation coefficient b and the first degradation weighting coefficient d to the offset value of the output (i.e., the reference luminance compensation value) of the lookup table. When the average degradation value ΔAvg is 95%, the compensation target adjustor 151 adds the second average degradation coefficient b' and the second degradation weighting coefficient d' to the offset value of the reference luminance compensation value of the lookup table. When the average degradation value ΔAvg is 90%, the compensation target adjustor 151 adds the third average degradation coefficient b" and the third degradation weighting coefficient d" to the offset value of the reference luminance compensation value of the lookup table. In other words, the compensation target adjustor 151 changes the average degradation coefficient and the degradation weighting coefficient added to the output (i.e., the reference luminance compensation value) of the lookup table each time the average degradation value ΔAvg is reduced by the reference value (for example, 5%).

When the average degradation coefficient and the degradation weighting coefficient are added to the output (i.e., the reference luminance compensation value) of the lookup table, the compensation target and a final luminance compensation value are determined. The data modulator 152 adds and subtracts the determined final luminance compensation value to and from the input digital video data RGB.

Figure 13:
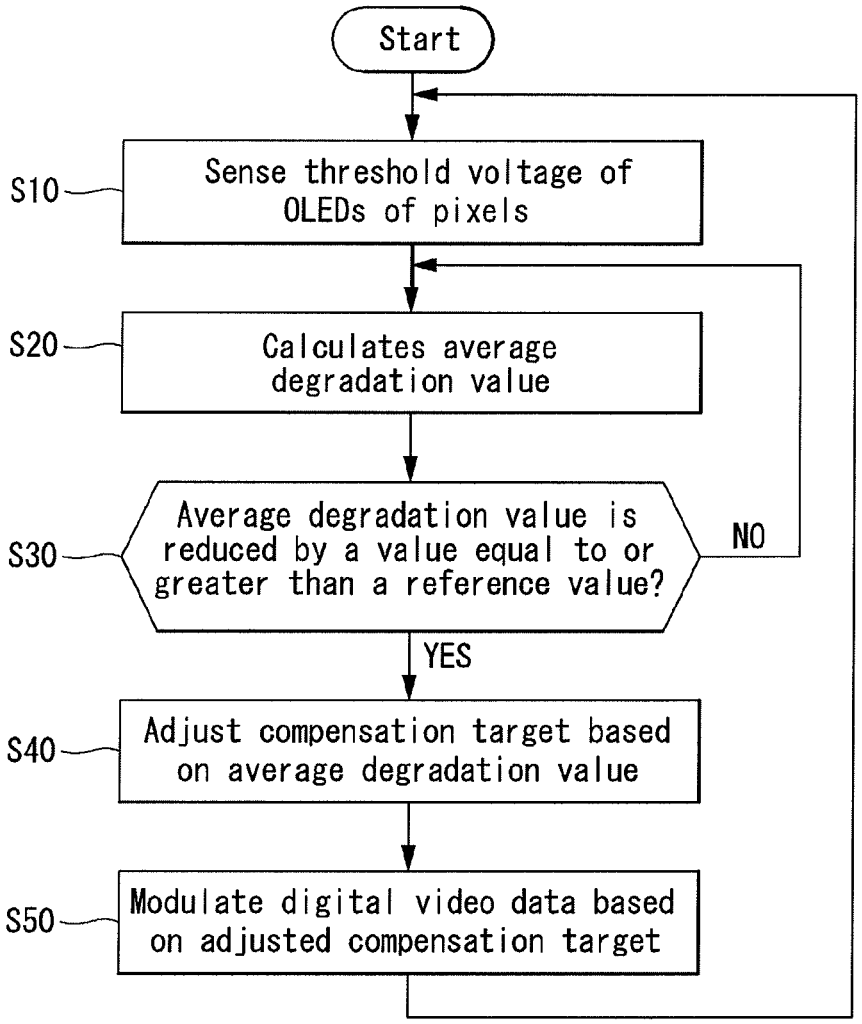
FIG. 13 illustrates a degradation compensation method of an organic light emitting display according to an example embodiment of the invention.

FIG. 13 illustrates a degradation compensation method of the organic light emitting display according to the embodiment of the invention.

As shown in FIG. 13, the degradation compensation method of the organic light emitting display according to the embodiment of the invention senses the threshold voltage ΔVsen of the OLEDs included in the pixels in step S10.

The degradation compensation method calculates the average degradation value ΔAvg, which is defined by the average luminance value due to the degradation, based on the threshold voltage ΔVsen of the OLEDs obtained by a sensing operation in step S20.

The degradation compensation method decides whether or not the average degradation value ΔAvg is reduced by a previously determined reference value in step S30. Each time the average degradation value ΔAvg is reduced by the previously determined reference value as the result of a decision, the degradation compensation method adjusts the compensation target, which is a criterion of the luminance compensation, based on the average degradation value ΔAvg in step S40.

The degradation compensation method adds and subtracts the luminance compensation value determined by the adjusted compensation target to and from the input digital video data to modulate the input digital video data in step S50.

As described above, the organic light emitting display and the degradation compensation method thereof according to the embodiment of the invention adjusts the compensation target depending on the degradation degree of the OLEDs of the pixels to thereby reduce the luminance gap between the compensation target and the luminance subject to compensation. Hence, the compensation error is minimized, and the compensation performance may be improved without breaking the luminance balance and the color balance. Furthermore, the organic light emitting display and the degradation compensation method thereof according to the embodiment of the invention adjusts the compensation target depending on the degradation degree of the OLEDs to thereby reduce the entire luminance of the screen of the display panel. Hence, the power consumption required to compensate for the degradation of the OLEDs may be reduced.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An organic light emitting display comprising:

a display panel configured to display an image, the display panel including a plurality of pixels;

a degradation sensing circuit configured to sense a threshold voltage of organic light emitting diodes included in the pixels and calculate an average degradation value defined by an average luminance value due to the degradation based on the sensed threshold voltage of the organic light emitting diodes;

a compensation target adjustor configured to adjust a compensation target, which is a criterion of the luminance compensation, based on the average degradation value, each time the average degradation value is reduced by a previously determined reference value; and a data modulator configured to add and subtract a luminance compensation value determined depending on the adjusted compensation target to and from input digital video data and modulate the input digital video data, wherein each time the average degradation value is reduced by the previously determined reference value, the compensation target adjustor reduces stepwise the compensation target in conformity with changes in the average degradation value.

2. The organic light emitting display of claim 1, wherein a stepwise adjustment width of the compensation target is uniform.

3. An organic light emitting display comprising:

a display panel configured to display an image, the display panel including a plurality of pixels;

a degradation sensing circuit configured to sense a threshold voltage of organic light emitting diodes included in the pixels and calculate an average degradation value defined by an average luminance value due to the degradation based on the sensed threshold voltage of the organic light emitting diodes;

a compensation target adjustor configured to adjust a compensation target, which is a criterion of the luminance compensation, based on the average degradation value, each time the average degradation value is reduced by a previously determined reference value; and a data modulator configured to add and subtract a luminance compensation value determined depending on the adjusted compensation target to and from input digital video data and modulate the input digital video data, wherein the compensation target adjustor includes:

a lookup table, in which a reference luminance compensation value is previously stored; and an offset adjustor which adjusts an offset value of the reference luminance compensation value output from the lookup table to change the compensation target.

4. The organic light emitting display of claim 3, wherein the offset adjustor adds one of average degradation coefficients, which are previously set depending on the average degradation value, to the reference luminance compensation value to adjust the offset value of the reference luminance compensation value.

5. The organic light emitting display of claim 4, wherein the offset adjustor additionally adds one of degradation weighting coefficients, which are previously set depending on the average degradation value, to the reference luminance compensation value to adjust the offset value of the reference luminance compensation value.

6. A degradation compensation method of an organic light emitting display including a display panel, which includes a plurality of pixels and displays an image, the degradation compensation method comprising:

sensing a threshold voltage of organic light emitting diodes included in the pixels and calculating an average degradation value defined by an average luminance value due to the degradation based on the sensed threshold voltage of the organic light emitting diodes;

adjusting a compensation target, which is a criterion of the luminance compensation, based on the average degradation value, each time the average degradation value is reduced by a previously determined reference value; and adding and subtracting a luminance compensation value determined depending on the adjusted compensation target to and from input digital video data and modulating the input digital video data, wherein the adjusting of the compensation target includes, each time the average degradation value is reduced by the previously determined reference value, reducing stepwise the compensation target in conformity with changes in the average degradation value.

7. The degradation compensation method of claim 6, wherein a stepwise adjustment width of the compensation target is uniform.

8. The degradation compensation method of claim 6, wherein a stepwise adjustment width of the compensation target is non-uniform.

9. The degradation compensation method of claim 8, wherein the stepwise adjustment width of the compensation target gradually increases in conformity with changes in the average degradation value.

* * * * *